US007579994B2

(12) United States Patent
Bacquet et al.

(10) Patent No.: US 7,579,994 B2
(45) Date of Patent: Aug. 25, 2009

(54) FLAT PLATE ANTENNA WITH A ROTATING FIELD, COMPRISING A CENTRAL LOOP AND ECCENTRIC LOOPS, AND SYSTEM FOR IDENTIFICATION BY RADIOFREQUENCY

(75) Inventors: Sylvain Bacquet, Grenoble (FR); Thierry Thomas, Varces Allieres et Risset (FR); Elisabeth Crochon, Poisat (FR); François Vacherand, Le Pont de Claix (FR)

(73) Assignee: Commissariat a l'Energie Atomique, Paris (FR)

( * ) Notice: Subject to any disclaimer, the term of this patent is extended or adjusted under 35 U.S.C. 154(b) by 518 days.

(21) Appl. No.: 10/581,670

(22) PCT Filed: Dec. 2, 2004

(86) PCT No.: PCT/FR2004/003090

§ 371 (c)(1),
(2), (4) Date: Jun. 5, 2006

(87) PCT Pub. No.: WO2005/069440

PCT Pub. Date: Jul. 28, 2005

(65) Prior Publication Data

US 2007/0109210 A1 May 17, 2007

(30) Foreign Application Priority Data

Dec. 17, 2003 (FR) ..... 03 14781

(51) Int. Cl.
*H01Q 11/12* (2006.01)

(52) U.S. Cl. ..... 343/742; 343/741; 343/732; 343/867

(58) Field of Classification Search ..... 343/742
See application file for complete search history.

(56) References Cited

U.S. PATENT DOCUMENTS 4,480,255 A * 10/1984 Davidson ..... 343/844

(Continued)

FOREIGN PATENT DOCUMENTS

DE 200 12 099 U1 1/2001

(Continued)

*Primary Examiner*—Trinh V Dinh
(74) *Attorney, Agent, or Firm*—Oliff & Berridge, PLC

(57) ABSTRACT

An antenna includes a central loop and four adjacent coplanar eccentric loops. The central loop creates a magnetic field that is essentially perpendicular to the antenna. The centres of gravity of the four eccentric loops are essentially located on the periphery of the central loop and the eccentric loops are supplied in such a way as to predominantly create a rotating field in a plane parallel to the plane of the antenna. The eccentric loops can be associated in pairs of non-adjacent loops in such a way as to generate electromagnetic fields of opposite phases in the respective pair. In this way, the two loops of a pair can be connected such that the same current flows through them in opposite trigonometric directions. A radiofrequency generator can supply first and second excitation signals alternately on two outputs, respectively to the central loop and to the eccentric loops.

14 Claims, 3 Drawing Sheets

U.S. PATENT DOCUMENTS

| | | | | |
|---|---|---|---|---|
| 5,005,001 | A | 4/1991 | Cordery | |
| 6,020,856 | A | 2/2000 | Alicot | |
| 6,512,494 | B1 * | 1/2003 | Diaz et al. | 343/909 |
| 6,650,213 | B1 | 11/2003 | Sakurai et al. | |
| 6,774,867 | B2 * | 8/2004 | Diaz et al. | 343/909 |
| 7,075,485 | B2 * | 7/2006 | Song et al. | 343/700 MS |
| 2003/0052783 | A1 | 3/2003 | Sitzman | |
| 2003/0184295 | A1 * | 10/2003 | Martin et al. | 324/318 |
| 2003/0197652 | A1 | 10/2003 | Yang et al. | |
| 2003/0234744 | A1 * | 12/2003 | Podger | 343/742 |
| 2005/0195084 | A1 * | 9/2005 | Dimmer et al. | 340/572.7 |

FOREIGN PATENT DOCUMENTS

| | | | |
|---|---|---|---|
| EP | 1 357 635 | A1 | 10/2003 |

* cited by examiner

FLAT PLATE ANTENNA WITH A ROTATING FIELD, COMPRISING A CENTRAL LOOP AND ECCENTRIC LOOPS, AND SYSTEM FOR IDENTIFICATION BY RADIOFREQUENCY

This application is a 371 of PCT/FR04/03090 filed Dec. 2, 2004, and claims the benefit of a foreign application, France 03 14781 filed Dec. 17, 2003.

BACKGROUND OF THE INVENTION

The invention relates to a substantially flat rotating field antenna comprising a central loop and coplanar eccentric loops.

STATE OF THE ART

Radiofrequency identification systems enable contact-free data exchange by inductive coupling between a read unit and objects to be identified, conventionally tags. The energy necessary for the tags is taken from the electromagnetic field.

The read unit emits an electromagnetic field in an exchange zone limited by the emitting power of the read unit. The data are transmitted between the read unit and the tag by modulation of the electromagnetic field. Due to the shape of the field lines, data exchange can only be performed for particular relative positions of the tags with respect to an antenna of the read unit.

A read unit equipped with an antenna having a single flat loop plane enables data to be transferred in the centre of the antenna to a correctly directed tag, in particular if it is parallel to the plane of the loop of the antenna. The inductive coupling between the antenna and a tag positioned in a plane orthogonal to the plane of the loop is weaker and often insufficient to detect the tag. This is due to the fact that, in the centre of the antenna, the magnetic field lines are perpendicular to the plane of the loop and, the flux flowing through the tag is therefore minimum when the tag is arranged in a plane perpendicular to the plane of the loop. On the contrary, when the tag is parallel to the plane of the loop, the flux flowing through the tag is maximum.

Moreover, according to international radiofrequency radiation emission standards, the emission power is limited by -the field level at a distance of 10 m from the antenna, which limits the possibility of compensating an angle of incline of the tag by a more intense field.

U.S. Pat. No. 6,166,706 describes a substantially flat rotating field antenna comprising a central loop and two coplanar eccentric loops. The two eccentric loops are connected and supplied in parallel. The central antenna is supplied, in phase quadrature, by inductive coupling with the eccentric loops. The antenna thus produces a rotating field in a plane orthogonal to the plane of the antenna. A tag located in this plane cannot be detected.

Moreover, other types of antennas are described in the documents U.S. Pat. No. 5,005,001 and U.S. Pat. No. 6,650,213:

The document U.S. Pat. No. 5,005,001 describes a system of antennas comprising rectangular first coils arranged facing one another so as to form a portal, to generate a non-rotating magnetic field. In addition, the system comprises means for creating a rotating magnetic field using two pairs of additional coils respectively arranged in the same plane as the first coils, inside the latter. The two additional coils of each pair are connected in such a way that the same current flows through them with a phase difference of 180°. Thus, the document U.S. Pat. No. 5,005,001 describes two substantially flat rotating field antennas arranged facing one another. Each antenna comprises a peripheral loop and two coplanar internal loops.

The document U.S. Pat. No. 6,650,213 describes an antenna formed by a set of four adjacent coplanar coils. A magnetic field control element enables the polarity and phase of the magnetic field generated by each coil to be controlled, so as to modify the direction of the magnetic field near the set of coils to guide a spherical semi-conducting element in the direction of the set of coils. Two adjacent coils are positively polarized and the other two coils are negatively polarized.

Whatever the shape of the antennas or whatever the direction of the field created by the antennas, perpendicular to the antenna plane for U.S. Pat. No. 5,005,001 or parallel to the antenna plane for U.S. Pat. No. 6,650,213, a dead zone of the field always remains, perpendicular to the electric conductors that form the antenna.

OBJECT OF THE INVENTION

It is one object of the invention to remedy these shortcomings and, in particular, to provide a flat antenna enabling a radiofrequency identification tag having any orientation to be detected, while limiting the field level at a distance of 10 m from the antenna.

According to the invention, this object is achieved by the appended claims and, in particular, by the fact that, the central loop creating a magnetic field essentially perpendicular to the antenna, the antenna comprises four adjacent coplanar eccentric loops, supplied in such a way as to create a rotating field predominantly in a plane parallel to the plane of the antenna, the centres of gravity of the eccentric loops being arranged substantially on the periphery of the central loop.

It is a further object of the invention to provide a system for identification by radiofrequency comprising a rotating field antenna and a radiofrequency generator comprising first and second outputs alternately supplying first and second excitation signals respectively to the central loop and to the eccentric loops.

BRIEF DESCRIPTION OF THE DRAWINGS

Other advantages and features will become more clearly apparent from the following description of particular embodiments of the invention given as non-restrictive examples only and represented in the accompanying drawings, in which.

DESCRIPTION OF PARTICULAR EMBODIMENTS

Figure 1:
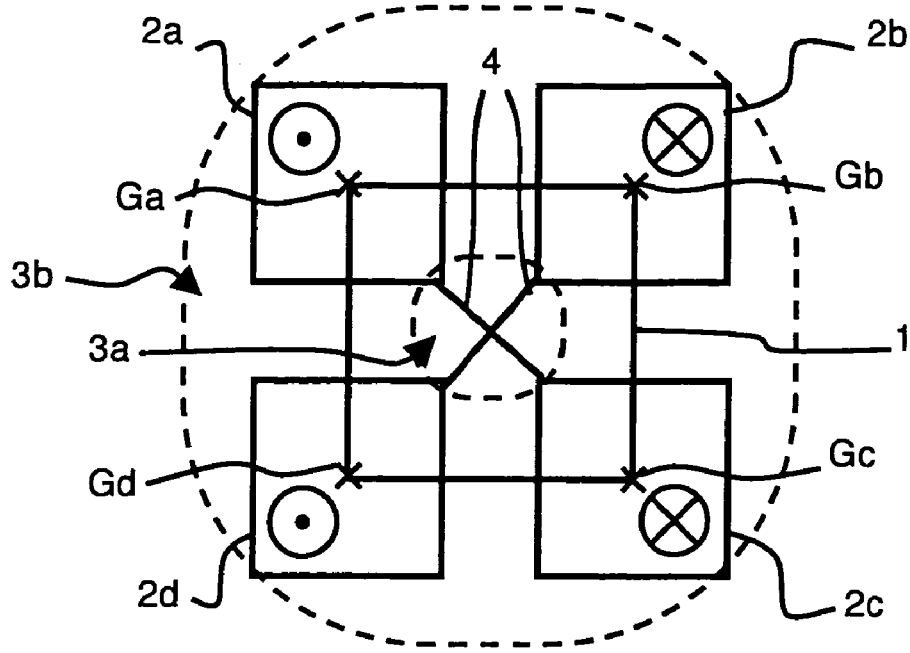
FIGS. 1 and 2 schematically illustrate two particular embodiments of an antenna according to the invention.
Figure 2:
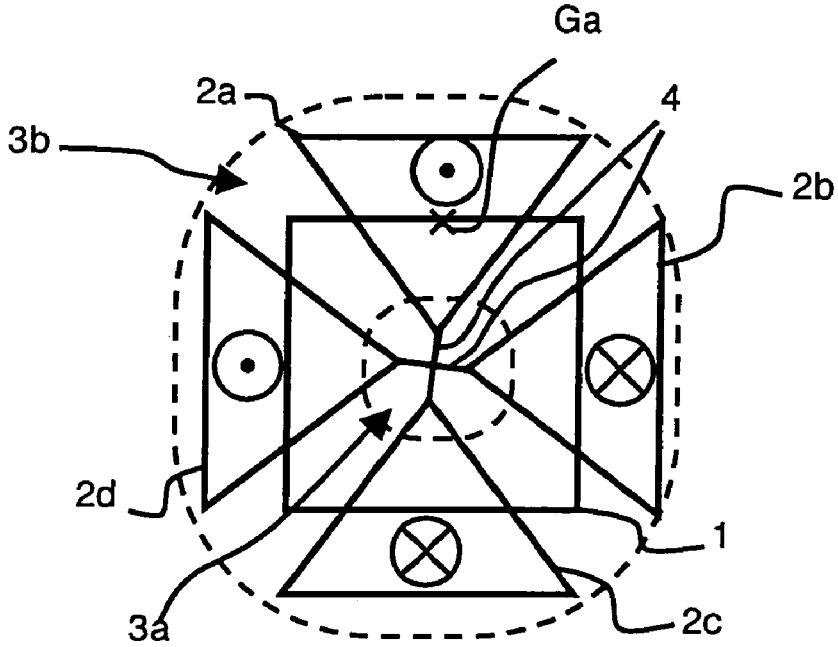

In both FIGS. 1 and 2, a rotating field antenna comprises a substantially rectangular central loop 1 and four adjacent coplanar eccentric loops 2 (2*a*, 2*b*, 2*c*, 2*d*). The eccentric loops 2 and the central loop 1 are essentially arranged in the same plane. The antenna is then substantially flat. As represented in FIGS. 1 and 2, the four eccentric loops (2) can be arranged symmetrically with respect to the centre of the central loop.

The four eccentric loops 2 can be supplied in such a way that two adjacent eccentric loops 2 have a phase difference of 90° and two non-adjacent eccentric loops 2 therefore have a phase difference of 180°. In this way, the superposed fields of the four eccentric loops 2 create a rotating magnetic field mainly in a plane parallel to the plane of the antenna.

The central loop 1, independently from the eccentric loops 2, creates a magnetic field that is essentially perpendicular to the antenna, presenting a maximum in a central zone 3*a* represented by a broken line, extending in volume perpendicularly to the plane of the antenna.

As represented in FIGS. 1 and 2, the centres of gravity G (Ga, Gb, Gc, Gd) of the eccentric loops 2 are located substantially on the periphery of the central loop 1. In this way, the rotating field in the plane of the antenna, created by the eccentric loops, has a maximum in the central zone 3*a*.

Analysis of the magnetic fields created by the eccentric loops 2 on the one hand, and by the central loop 1 on the other hand, shows that the distribution of the fields is substantially complementary in the central zone 3*a* and in a peripheral zone 3*b* of the central zone 3*a*. Indeed, as indicated above, the central loop 1 creates a magnetic field component perpendicular to the plane of the antenna, in the central zone 3*a*, whereas the eccentric loops 2 create a rotating component in the plane of the antenna, in the central zone 3*a*. Inversely, in the peripheral zone 3*b* of the central zone 3*a*, the central loop 1 creates magnetic field components oriented in the plane of the antenna, whereas the eccentric loops 2 create a component perpendicular to the plane of the antenna.

The antenna can therefore detect a tag positioned in any direction and located in the exchange zone formed by the central zone 3*a* and the peripheral zone 3*b*. The magnetic field components perpendicular to the plane of the antenna enable tags located in a plane parallel to the antenna to be detected, whereas the magnetic field components arranged in the plane of the antenna enable tags located in a plane orthogonal to the plane of the antenna to be detected.

In FIG. 1, the eccentric loops 2 are substantially rectangular. The shape of the loops constituting the antenna influences the magnetic field distribution. To improve detection of tags located orthogonally to the plane of the antenna, a triangular shape of the eccentric loops 2 is more suitable than a rectangular or square shape. Indeed, for the same surface, a triangular loop creates more horizontal field lines than a square loop. Thus, in the preferred embodiment illustrated in FIG. 2, the eccentric loops 2 are substantially triangular, an apex of each triangle being located in the central zone 3*a* of the antenna. However, other shapes can be envisaged, such as for example a circular central loop 1 and eccentric loops 2 in the shape of a sector of a circle.

Figure 3:
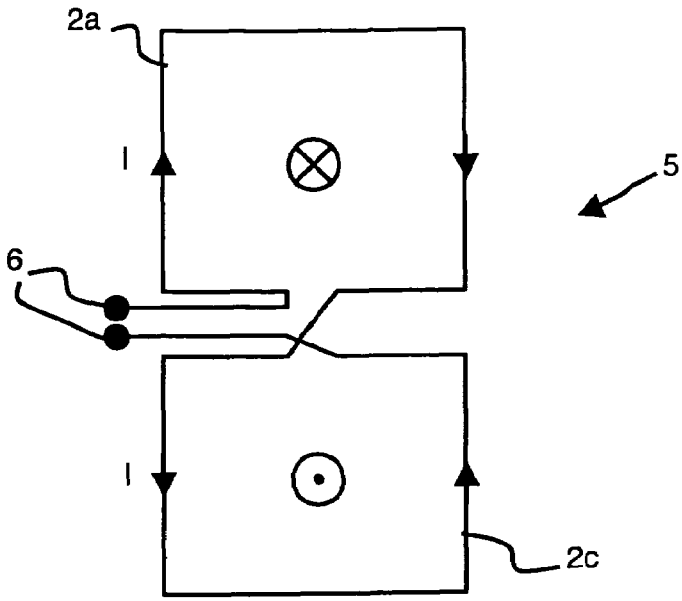
FIG. 3 represents a particular embodiment of two eccentric loops associated with an antenna according to the invention.

In the embodiments represented in FIGS. 1 and 2, the eccentric loops 2 are associated in pairs of non-adjacent loops (their connection is represented schematically by a single line 4), so as to generate electromagnetic fields of opposite phases in said pair. For example, as represented in FIG. 3, two eccentric loops 2*a* and 2*c* are formed by a conductor 5 arranged in the shape of an 8. The conductor 5 is supplied by terminals 6 common to the two loops 2*a* and 2*c*. An electric current I thus flows first through the first loop 2*a* of the conductor 5 in a first direction and then automatically through the second loop 2*c* of the conductor 5 in a second direction, opposite to the first. The two loops 2*a* and 2*c* are then connected in such a way that the same current flows through them in opposite trigonometric directions. The set of four eccentric loops 2 can thus be formed by an assembly of two conductors 5 superposed substantially in the same plane, with a 90° offset in this plane. The two conductors 5 do however have to be positioned at a minimum distance to limit capacitive couplings. In addition, locating the two conductors 5 at a distance from one another enables the volume of the rotating field to be increased.

It is particularly interesting to achieve a symmetric antenna, i.e. with eccentric loops 2 that are symmetric with respect to the centre of the central antenna 1. Moreover, this symmetry plus the fact that the fields of the eccentric loops 2 are in phase opposition two by two, means that the total field at 10 m is practically zero. The standard characterized by a field at 10 m lower than a set threshold can be easily respected even with powers of the eccentric loops 2 that are higher than in the prior art.

Figure 4:
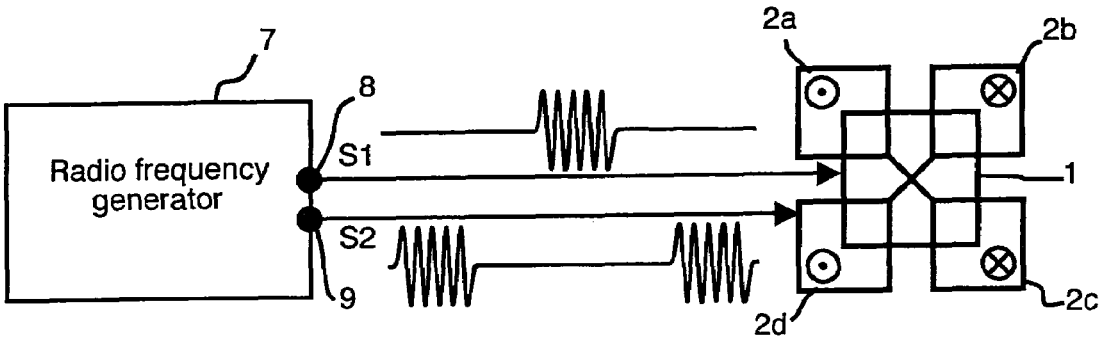
FIG. 4 represents a particular embodiment of an identification system according to the invention.

In FIG. 4, a radiofrequency identification system comprises a radiofrequency generator 7, in addition to the rotating field antenna. The generator 7 comprises a first output 8 and a second output 9 alternately supplying first S1 and second S2 excitation signals, respectively to the central loop 1 and to the eccentric loops 2. In this way, the rotating field created by the eccentric loops 2 does not interfere with the field created by the central loop 1. Simultaneous supply of the central loop 1 and of the eccentric loops 2 can in fact, by destructive interference, create magnetic field minima in the central zone 3*a* and the peripheral zone 3*b*.

However, simultaneous supply of the central loop 1 and the eccentric loops 2 also creates maxima. It can therefore be of interest to supply the different central loops 1 and eccentric loops 2 according to activation cycles successively, for example, the central loop 1, then the eccentric loops 2, then all the loops, etc.

To take advantage of the field maxima described above when the central loop 1 and the coplanar eccentric loops 2 are operating simultaneously, the fields can be made to rotate so that they scan the whole exchange zone. This can, for example, be achieved if the first S1 and second S2 excitation signals have slightly different frequencies. For example, for radiofrequency identification operation at 13.56 MHz, it is theoretically possible to have a frequency offset of 7 kHz. Practically, taking account of the noise and the margins taken for satisfactory operation, this offset is reduced to 1 kHz or 2 kHz. This solution is therefore preferably accompanied by powerful software processing on account of the time the tags are present in the field, typically about a few milliseconds.

Figure 5:
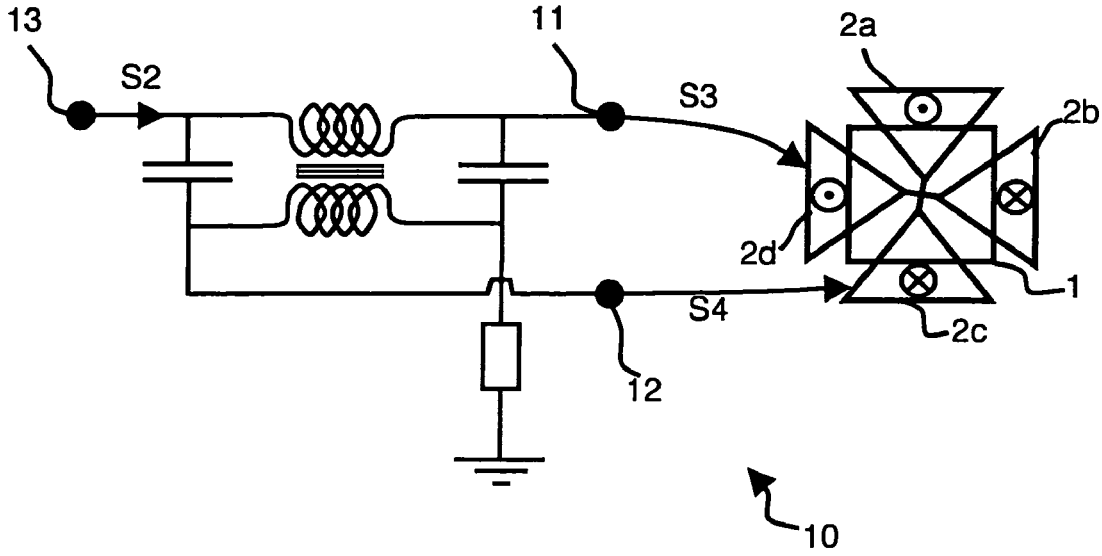
FIG. 5 schematically represents a particular embodiment of phase shifting means of an identification system according to the invention.

As represented in FIG. 5, the phase quadrature phase difference of the adjacent eccentric loops 2*d* and 2*c* can be performed by a phase shifter power divider 10 respectively supplying signals S3 and S4 in phase quadrature on its two outputs 11 and 12. An input 13 of the power divider 10 is preferably connected to the second output 9 of the radiofrequency generator 7. The eccentric loops 2 represented in FIG. 5 are also associated in pairs (2*a* and 2*c*, 2*b* and 2*d*). In this way, the two loops of a pair can, as represented in FIG. 3, be connected to one another and to common terminals 6, so that a single current I flows through these loops in opposite trigonometric directions. The signals S3 and S4 are applied respectively to the common terminals 6 of each of the two pairs. In this way, each eccentric loop 2 is supplied in phase quadrature with respect to its two adjacent loops.

The dimensions of the antenna depend on the application for which the latter is intended. For an application in a close field identification system, a surface of 10 cm×15 cm is sufficient and enables a three-dimensional magnetic field of more than 5 A/m to be generated in the central zone 3*a* and the peripheral zone 3*b* in the plane of the antenna, while respecting international radiofrequency radiation emission standards.

For a mobile equipment recharging application, for example for recharging a mobile telephone or a walkman, a larger surface of about 25 cm×25 cm is appropriate. For example, a mobile telephone equipped with an electromagnetic induction recharge module can be recharged by placing it on the antenna, whatever its orientation.

For identification in a farther field, for example about 1 $m^3$ a surface of 1 $m^2$ is necessary.

The invention claimed is:

1. A substantially flat rotating field antenna comprising:

a central loop the central loop being structured to create a magnetic field essentially perpendicular to the antenna; and four adjacent coplanar eccentric loops, the eccentric loops being structured and supplied to create a rotating field predominantly in a plane parallel to a plane of the antenna, the eccentric loops being spaced apart from each other and being spaced from a center of the central loop, and a center of gravity of each eccentric loop being arranged substantially on a periphery of the central loop.

2. The antenna according to claim 1, wherein the eccentric loops are associated in pairs of non-adjacent loops so as to generate electromagnetic fields of opposite phases in the pairs.

3. The antenna according to claim 2, wherein the two eccentric loops of a pair are connected in such a way that a same current is flowing through them in opposite trigonometric directions.

4. The antenna according to claim 2, wherein each pair of non-adjacent loops is formed by a conductive material.

5. The antenna according to claim 1, wherein the eccentric loops are arranged symmetrically with respect to the center of the central loop.

6. The antenna according to claim 1, wherein the central loop is substantially rectangular.

7. The antenna according to claim 1, wherein the eccentric loops are substantially triangular, an apex of each triangle being located in a central zone of the antenna.

8. The antenna according to claim 1, wherein the eccentric loops are substantially rectangular.

9. The antenna according to claim 1, wherein the eccentric loops are formed of a conductive material.

10. A radio frequency identification system comprising:

a substantially flat rotating field antenna, the antenna including:

a central loop, the central loop being structured to create a magnetic field essentially perpendicular to the antenna; and four adjacent coplanar eccentric loops, the eccentric loops being structured and supplied to create a rotating field predominantly in a plane parallel to a plane of the antenna, centers of gravity of the eccentric loops being arranged substantially on a periphery of the central loop; and a radiofrequency generator including first and second outputs respectively supplying first and second excitation signals alternately respectively to the central loop and to the eccentric loops.

11. The system according to claim 10, further comprising phase shift means connected to the second output and supplying phase quadrature signals to the eccentric loops.

12. The system according to claim 10, wherein the eccentric loops are associated in pairs, two eccentric loops of a pair being connected to one another and to common terminals, so that a same current flows through them in opposite trigonometric directions, the system further comprising a power divider connected to the second output of the generator and supplying phase quadrature signals, on two outputs, respectively applied to the common terminals of each of the pairs.

13. The system according to claim 10, wherein the radiofrequency generator comprises means able to supply first and second excitation signals at different frequencies.

14. A substantially flat rotating field antenna comprising:

a central loop, the central loop being structured to create a magnetic field essentially perpendicular to the antenna; and two conductors, each conductor forming a pair of non-adjacent coplanar eccentric loops, the pairs being structured and supplied to create a rotating field predominantly in a plane parallel to the plane of the antenna and to generate electromagnetic fields of opposite phases in the pairs, and centers of gravity of each eccentric loop being arranged substantially on a periphery of the central loop.

* * * * *